United States Patent [19]

Senften

[11] Patent Number: 4,529,234

[45] Date of Patent: Jul. 16, 1985

[54] ELECTRICAL OPERATING MEANS FOR DOOR LOCK MECHANISMS

[75] Inventor: David A. Senften, Florissant, Mo.

[73] Assignee: Architectural Control Systems Incorporated, St. Louis, Mo.

[21] Appl. No.: 427,834

[22] Filed: Sep. 29, 1982

[51] Int. Cl.[3] ..... E05C 1/12

[52] U.S. Cl. ..... 292/169.15; 292/150; 292/254; 292/341.16; 70/279; 70/283

[58] Field of Search ..... 292/37, 40, 181, 144, 292/150, 153, 254, 341.16, 169.13, 169.15; 70/279, 281, 283

[56] References Cited

U.S. PATENT DOCUMENTS

| | | | |
|---|---|---|---|
| 1,243,433 | 10/1917 | Lurie | 292/341.16 |
| 1,244,443 | 10/1917 | Hurd | 292/254 X |
| 1,270,468 | 6/1918 | Voight | 70/279 |
| 1,272,915 | 7/1918 | Cleaver | 292/150 X |
| 2,798,751 | 7/1957 | Walden | 292/144 |
| 3,890,608 | 6/1975 | Peterson | 292/144 X |
| 3,917,329 | 11/1975 | Fujiki et al. | 292/169.13 X |
| 4,132,439 | 1/1979 | Millar | 292/144 |
| 4,390,197 | 6/1983 | Butts | 292/144 |

*Primary Examiner*—Gary L. Smith
*Assistant Examiner*—Thomas J. Dubnicka
*Attorney, Agent, or Firm*—Gravely, Lieder & Woodruff

[57] ABSTRACT

A door locking assembly in which the latching mechanism of the assembly comprises a latch bolt operated by rotary means, which can be the door knob or a key operated tumbler, for normally operating the latch bolt, dead lock means for blocking the retraction of the latch bolt, auxiliary latch means having link means normally urging it into a position for moving the dead lock means out of latch bolt blocking position, electrically operable means cooperating with the latching mechanism for controlling the auxiliary latch means, lock bar means operative to prevent turning of the rotary means, and an operating element connected between the lock bar and the link means for the auxiliary latch means for determining the operative position of the lock bar means in relation to the position of the dead lock means relative to the latch bolt.

6 Claims, 4 Drawing Figures

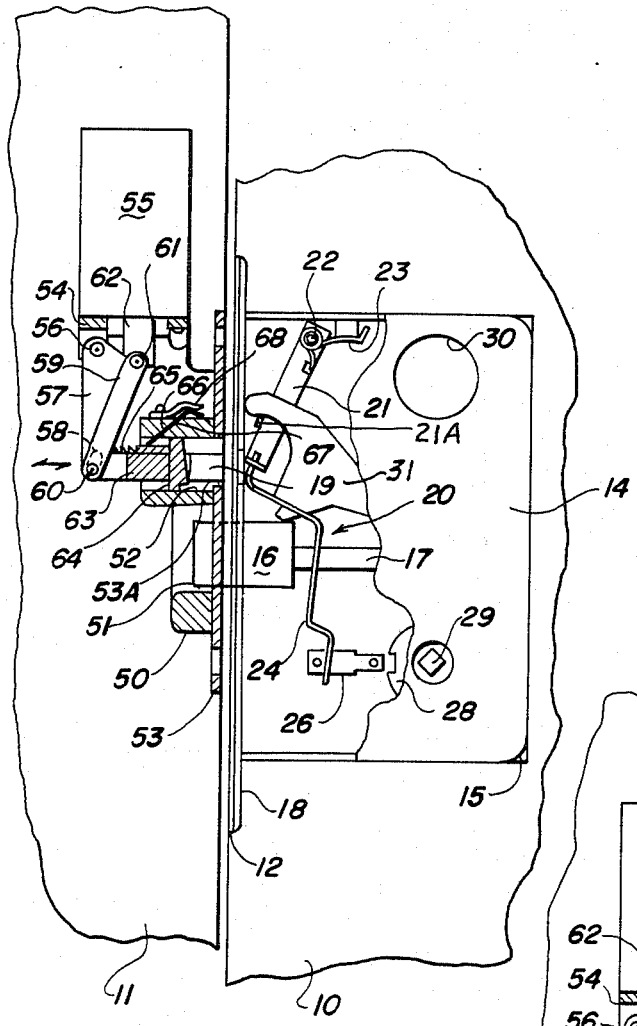
FIG. 3
FIG. 4
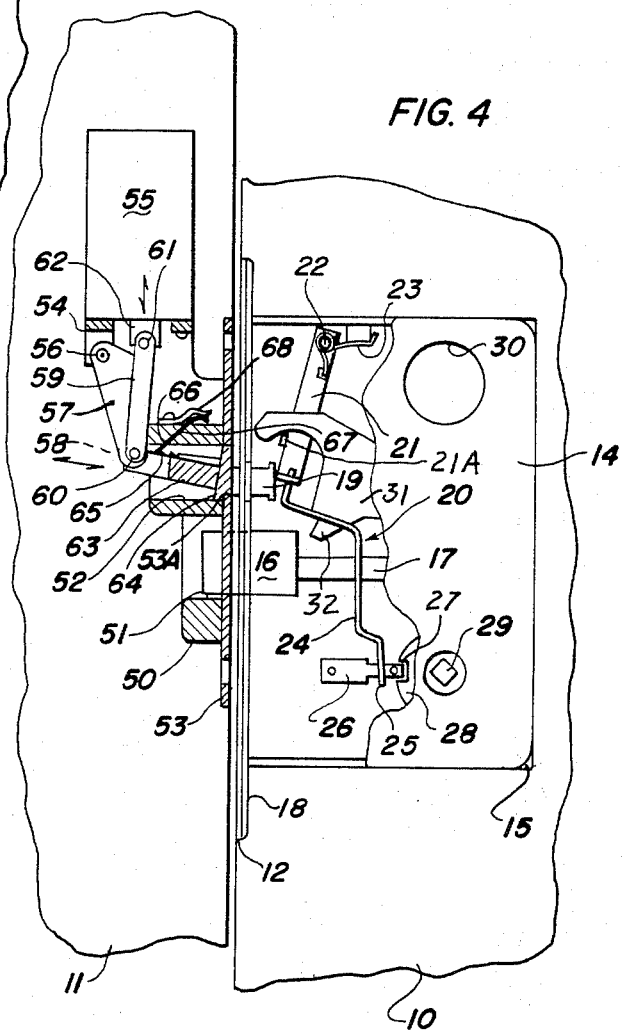

ELECTRICAL OPERATING MEANS FOR DOOR LOCK MECHANISMS

BACKGROUND OF THE INVENTION

1. Field of the Invention

The present invention is related to door lock mechanisms which are arranged to be electrically power locked or power unlocked.

2. Description of the Prior Art

Historically, electric locking devices have been loosely divided into two types. One is the electric dead bolt type designed specifically with that single function in mind. The other consists of standard mechanical locking hardware, modified to be operated electrically.

Electric dead bolt devices have faced some limitations in application because of their generally narrower scope of function. This is particularly true where building and safety codes call for free egress, panic egress, key override, or latched, but not locked status.

While these functions are readily available in mechanical locking hardware and can be preserved when electrical operation modifications are incorporated, the cost of the devices and the cost of their installation is significantly higher than that of their electric dead bolt counterparts. The additional costs arise from the special door preparations required for the modified lock cases, the addition and placement of wires in the door which connect to the lock, the necessity of special hinges to transfer the electrical circuits from the door to the door frame, and special preparation and wiring of the door frame to allow connection of the control circuits to the circuits from the door.

It is known to provide door locking mechanisms with electrically responsive dead-locking means. A means of this type is especially useful when the door locking means is required to be actuated from a remote location. Such an arrangement is seen in U.S. Pat. Nos. 4,132,439 issued Jan. 2, 1979, 3,521,921 of July 28, 1970 and in 4,099,752 of July 11, 1978. An early form of electrical operating means incorporated in a door locking mechanism is seen in U.S. Pat. No. 1,270,468 of June 25, 1918.

BRIEF DESCRIPTION OF THE INVENTION

The present invention is an improvement on the prior art related to electrical devices in combination with multifunctional characteristics of conventional mechanical locking hardware which provides, in addition to the standard latch bolt, an auxiliary latch. Means is provided to actuate the auxiliary latch for the purpose of applying the resulting motion to means which will lock the hub of the usual door knob and prevent its ability to turn, thereby securing a door in its closed position.

An important object of the present invention is to provide means incorporated in a standard door latch mechanism for preventing unlatching the mechanism by a card, or similar means, which may be capable of retracting the usual latch bolt.

An object of the present invention is to provide electrically responsive means for conditioning a door locking mechanism having an auxiliary latch for operation of the lock bar to secure the hub of the door knob against operation.

Another object of the present invention is to provide a lock actuating means suitable for use with conventional mechanical locking hardware and to operate such actuating means electrically in an inexpensive manner.

Other objects will be referred to in the following description related to certain preferred embodiments.

BRIEF DESCRIPTION OF THE DRAWINGS

The preferred embodiments are illustrated in the following views:

FIG. 3 is a schematic view of a modified electrical operating means in unlocked position; and FIG. 4 is a view similar to FIG. 3 but shown in the locked position.

DETAILED DESCRIPTION OF THE EMBODIMENTS

Figure 1:
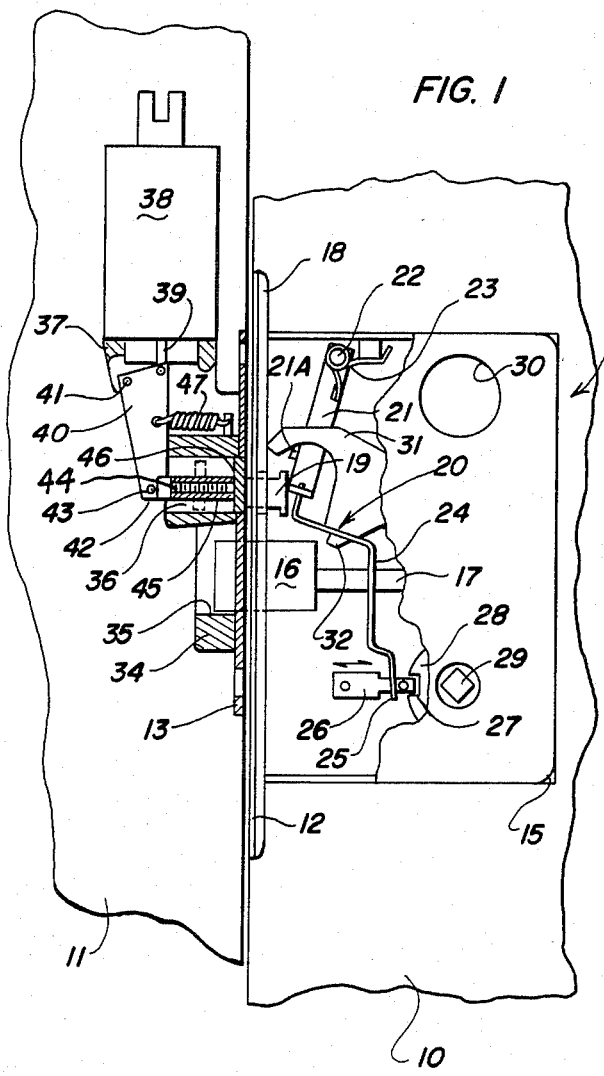
FIG. 1 is a fragmentary and partial sectional view of a mechanical door locking mechanism set in a door opposite the electrical operating means positioned in the door casing to cooperate with the door locking mechanism when locked.

In the drawings, FIG. 1 illustrates fragmentary portions of a door 10 and its frame 11 with the door in closed position such that the door face plate 12 is opposite the strike plate 13 on the face of the frame. The latch mechanism assembly is operably carried in a suitable slim box 14 which is received in the mortise recess 15, substantially as understood in the art.

The latch mechanism assembly includes a latch bolt 16 movable in response to mechanism (not shown) operating in the usual way through a link 17 attached to the latch bolt 16. The box 14 is provided with a mounting plate 18 which is covered by the face plate 12, and both plates 12 and 18 are formed with openings to allow the latch bolt 16 to extend into the frame 11 when needed. Further, the latch mechanism includes an auxiliary latch 19 of the type disclosed in Peterson U.S. Pat. No. 3,890,608 and incorporated herein by reference. The auxiliary latch has an action such that it affects the operation of link means 20 and eventually the secured or unsecured condition of the mechanism in box 14, as will appear. The auxiliary latch normally freely pivots on the mounting plate 18, as is understood in this art, so it cannot leave the box 14. The link means 20 is made up of an arm 21 operatively mounted on a suitable pivot element 22 and engaged by a suitable coil spring 23 which urges the arm 21 in a direction to press upon the auxiliary latch 19. The arm 21 has an extension or operating element 24 which has an end portion fastened to the arm 21 and the opposite end 25 is engaged rather loosely on a lock bar 26. The latter bar 26 moves in a slide, not shown due to the cover being broken away, and is intended to be brought into engagement and held in a notch 27 in the hub 28 of the shaft 29 operated by the door knob (not shown) used to slide the latch bolt 16 out of the way for opening the door 10 by actuating the link 17.

The mechanism in the box 14 also includes an opening 30 for a key operated cylinder lock (not shown) which, by suitable means, operates a dead lock lever 31 for swinging the lever 31 in a clockwise direction such that the projecting finger 32 is moved to clear the retraction path of the latch bolt 16 and allow key operated withdrawal of the latch bolt 16.

The cooperating components for the above described latch mechanism assembly are mounted in the door frame 11 and comprise a frame 34 attached to a strike plate 13. The plate 13 has openings 35 and 36 in the frame which act as receivers. In the form of the mechanism seen in FIG. 1, the receiver openings are in spaced relation, but in a cylindrical mechanism the receiver is usually a unitary opening as the latch bolt is round instead of rectangular as is latch bolt 16. The auxiliary latch in a cylindrical mechanism is usually a one-half round element.

As seen in FIG. 1, the frame 34 provides an attachment flange 37 for the mounting of an electrical solenoid 38 which may be either of AC or DC type. The armature in the solenoid operates a rod 39 pivotally connected to a link 40. The link 40 is provided with a pivot 41 in the flange 37, and its outer end 42 is connected by pivot pin 43 to an adjustable thrust pin 44 threaded into a sleeve 45 on a plunger 46 slidably mounted in the receiver opening 36. The sleeve 45 allows adjustment of the outer face of the plunger 46 to lie substantially flush with the striker plate 13 when the link 40 is held against the back of the receiver opening 36 by its return spring 47. In the view of FIG. 1 the position of plunger 46 corresponds to power-off to solenoid 38 whereby the spring 47 acts on plunger to push the auxiliary latch 19 back in box 14 which is in a direction to pivot the link means 20 and arm 21 against spring 23 to have lock bar 26 engage in the notch 27 in the hub 28 and block operation of the door knob to retract latch bolt 16.

Figure 2:
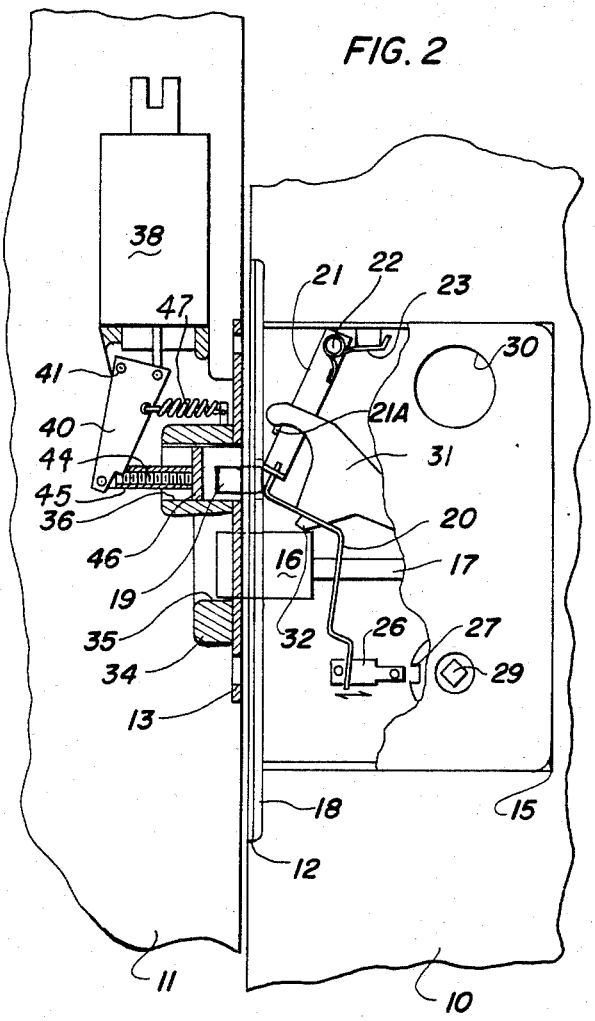
FIG. 2 is a view similar to FIG. 1 showing the assembly in unlocked position.

The view of FIG. 2 contains all of the elements, components and means described above. The difference over FIG. 1 is that the solenoid 38 is energized so that the link 40 is displaced or pushed about pivot 41 and the plunger 46 is recessed or drawn back in the receiver opening 36. This action allows the spring 23 in the mechanism in the door 10 to move arm 21 so it can push the auxiliary latch 19 against plate 18 so it projects beyond the face plate 12 which allows link means 20 to move the lock bar 26 out of the notch 27 so the latch bolt may be retracted. At the same time that the link means 20 is moved by spring 23, the arm 21, through a raised tab 21A, will swing the dead lock lever 31 in a direction to move the finger 32 away from the back of the latch bolt 16. Now the rotation of shaft 29 by the door knob will operate the latch bolt 16 so the door can be opened and auxiliary latch 19 will be free to move. However, in FIG. 2 the shaft 29 has not been rotated because notch 27 is still aligned with lock bar 26. Shaft 29 must be rotated to retract latch bolt 16.

A modified embodiment is shown in FIGS. 3 and 4. This mechanism may be used in place of the electrically responsive means mounted in the door frame 11 as in FIGS. 1 and 2. It is not thought necessary to show the complete latch mechanism assembly in box 14 in the door 10 as that has not been modified. The view of FIG. 3 embodies the frame 50 having receiver opening 51 for the latch bolt 16 and the receiver opening 52 for the auxiliary latch 19. These receivers are aligned with openings in the strike plate 53. The frame 50 has a portion 54 for mounting a solenoid 55 and for the pivot attachment 56 of the link 57 of modified triangular shape in which one end is formed with a slot 58, the major axis of which is directed at an acute angle to the straight margin directed to the pivot attachment 56. A second link 59 has one end carrying a pivot element 60 which is movable in the slot 58 in link 57, and the opposite end of link 59 is attached by pivot element 61 to the rod 62 in the solenoid 55.

A plunger 63 is mounted in the receiver 52, and an enlarged head 64 is formed on the plunger, the reason for which will appear. The inner end portion of the plunger 63 is operably connected to the link element 57 by the pivot pin 60 so that solenoid pull on the link 59 will cant the plunger 63 in the receiver opening 52. The slot 58 in link 57 allows link 59 to slide relative to the link 57 before the pivot 60 causes both links 57 and 59 to move together in a direction in which the connecting pivot 60 swings along an arc with center in pivot 56. The amount of canted reaction experienced by plunger 63 is sufficient to bring the surface of the head 64 into substantial flush alignment with the face of the striker plate 53. The outward travel of the plunger 63 toward the striker plate is arrested by abutment of the notch at the bottom of the head on plunger 63 (FIG. 4) on the strike plate lip 53A. The plunger 63 is provided with ratchet teeth 65 which cooperate with a lock pin 66 which is slidable in a bore 67 in the frame 50. Pin 66 has its inner end resiliently pressed into the ratchet teeth 65 by a resilient element in the nature of a leaf spring 68. When the plunger head 64 engages lip 53A (see FIG. 4) motion stops. As long as solenoid 55 is energized and holds the pin 66 engaged with the teeth 65 the plunger 64 cannot be forced backward in the receiver 52. Thus, unauthorized opening is prevented. In the view of FIG. 4, the arm 21 is pivoted against spring 23 so the link 20 swings in a direction to hold the bar 26 in notch 27 to block rotation of shaft 29. Concurrently, the dead lock lever 31 will position its finger 32 in the path of movement of latch bolt 16.

From the foregoing description it will become evident that the latching mechanism carried in the door 10 is equipped in the usual manner with a latch bolt 16 having an operating link 17 which is subject to movement to retract the latch bolt either by a door knob rotating shaft 29, or by a key operated cylinder lock mounted in opening 30 of the frame 14. There is also provided a dead lock lever 31 having a finger 32 which in a certain position blocks the retraction of the latch bolt 16 and in a second position is removed from the path of latch bolt movement by reason of a tab 21A on the arm 21 riding against the surface of the dead lock lever for moving the latter to unblock the latch bolt. It is not believed necessary to detail the mechanism which is responsive either to the operation of the shaft 29 by a door knob or by a key operated cylinder lock.

The improvement resides in the combination, with the arm 21 and the auxiliary latch 19, of the link extension 24 which is an operating element connected between the arm 21 and a lock bar 26 for positioning the lock bar to rest in the notch 27 in the rotary member 28 associated with shaft 29. The operation of the link extension or operating element 24 is subject to the electrical responsive mechanism carried in the door frame. The latch mechanism includes a plunger 46 which moves in the receiver 36 associated with the auxiliary latch 19, whereby when the plunger 46 is retracted in the receiver 36 by the operation of solenoid 38 through link 40, the auxiliary latch 19 is free to respond to the urging of spring 23 on the arm 21 to allow the lock bar 26 to be retracted from the notch 27. Concurrently, the tab 21A on arm 21 will move the dead lock lever 31 so the finger 32 will be out of the path of movement of the latch bolt 16. In this last described mechanism carried at the door frame 11, if the electrical power fails the spring 47 (FIG. 1) attached to link 40 will cause the plunger 46 to move out in the receiver 36 so as to lie substantially flush in the strike plate 13, thereby causing the auxiliary latch 19 to operate the links 21 and 24 so as to have the lock bar 26 engage in the notch 27. This is seen to be a fail secure arrangement.

Turning now to FIGS. 3 and 4, it is to be noted that upon the solenoid 55 being energized, the link 59 will cause the plunger 63 to assume a canted position in the receiver 52 prior to causing the link 57 to force the plunger 63 so that its head 64 will be substantially flush in the strike plate 53 thereby causing the auxiliary latch 19, previously discussed above, to operate the lock bar 26 as before described. The assembly of FIGS. 3 and 4 include means 65 and 66 in the form of a ratchet mechanism for preventing the insertion of an instrument between the door 10 and the frame 11 in an effort to push the plunger head 64 back in the receiver 52. However, if the power to the solenoid 55 should fail the movable parts of the assembly will have sufficient weight to gravitationally return the plunger 63 to a position where it will be released from the ratchet mechanism and thereby be moved back in the receiver 52 so as to release the lock bar 26 and simultaneously move the dead lock lever 31 to its position where the latch bolt 16 can be operated to unlatch the door 10. However, the shaft 29 has not been rotated as notch 27 is still aligned with the lock bar 26. Rotation of shaft 29 is required to retract the latch bolt 16 before the door can be opened. As long as the solenoid 55 is energized the lock bar 26 will engage notch 27, as in FIG. 4. This is seen to be a fail safe arrangement.

What is claimed is:

1. In a door and door frame combination in which the door carries a latching mechanism having a latch bolt and an auxiliary latch and the door frame carries a strike plate having receiver openings for the recption respectively of a latch bolt and an auxiliary latch, the improvement comprising:

(a) plunger means in the receiver opening for the auxiliary latch operable between positions substantially flush with the strike plate for excluding the auxiliary latch and withdrawn from such position for allowing auxiliary latch extension into said receiver opening;

(b) plunger operating means in the door frame for selectively positioning said plunger in flush and withdrawn positions relative to the strike plate;

(c) latch operating means in the door carried latching mechanism including a rotatable shaft and a lock bar for selectively engaging said rotatable shaft to block or unblock its rotation; and (d) link means operably connected to said lock bar for actuating the lock bar, said link means having an arm resiliently responsive to the position of the auxiliary latch and an operating element extending into contact with said lock bar, whereby with said plunger substantially flush with the strike plate and the auxiliary excluded from the receiver opening, said lock bar is moved by said operating element of said link means into engagement with said rotatable shaft to block its rotation.

2. In a door and door frame combination in which the door carries a latching mechanism in a supporting box having a latch bolt and an auxiliary latch and the door frame carries an auxiliary latch operator having a frame with separate receiver openings for the latch bolt and auxiliary latch and a strike plate presented to the door carried latch bolt and auxiliary latch, the improvement comprising:

(a) plunger means operable in the frame in the receiver opening for the auxiliary latch, said plunger means being movable selectively between a position in which the receiver opening is closed to the auxiliary latch and a position in which the receiver opening is open to allow entry of the auxiliary latch;

(b) plunger operating means in the door frame for selectively positioning said plunger means in either of its said positions;

(c) latch bolt operating means in the latch mechanism carried by a supporting box in the door including a rotary member;

(d) locking bar means adjacent said rotary member and movable to engage and arrest rotation of said rotary member; and (e) link means movably mounted in the door latching mechanism and operable to follow the movement of the auxiliary latch, said link means having an arm responsive to the position of the auxiliary latch position with the receiver opening closed, and an operating element interconnecting said arm and said locking bar means to move said locking bar into a position to engage and arrest said rotary member.

3. The improvement set forth in claim 2 wherein said plunger operating means includes other link means in the door frame connected to said plunger; and electrically operable actuator connected to said other link means for positioning said plunger means in at least one of its selective positions.

4. The combination of latching mechanism carried by a door and electrically responsive operating means for the latching mechanism in the frame for the door, said combination comprising:

(a) a door latch bolt operably carried in the door for movement into and out of engagement in the door frame;

(b) dead lock means carried in the door and movable between a position engaged with and blocking latch bolt movement out of the door frame and a position clear of said latch bolt;

(c) auxiliary latch means carried by the door and movable between a first position projecting out of the door and into the door frame and a second position within the door and clear of the door frame;

(d) latch bolt operating means in the door including a rotary element provided with a notch;

(e) lock bar means operable in the door for engaging and disengaging said notch in said rotary element;

(f) first link means resiliently moved toward a position to urge said auxiliary latch toward the first mentioned position, said first link means having a coacting responsive extension element arranged for engagement with said dead lock means for holding it clear of said latch bolt;

(g) electrically responsive means in the door frame having plunger means for moving said auxiliary latch to said second position clear of the door frame to allow said dead lock means to move to a position blocking operation of said latch bolt; and (h) second link means movable with said first link means and having engagement with said lock bar means to operate said lock bar means into engagement with said rotary element upon movement of said auxiliary latch to its said second position clear of the door frame.

5. The combination set forth in claim 4 wherein said plunger means in said electrically responsive means is effective to move to a position in which said auxiliary latch assumes said first position and is movable to another position in which said auxiliary latch is movable to a position in which it clears the door frame with electrical power off.

6. The combination of latching mechanism carried by a door and electrically responsive operating means for the latching mechanism in the frame for the door, said combination comprising:

(a) a door latch bolt operably carried in the door for movement into and out of engagement in the door frame;

(b) dead lock means carried in the door and movable into and out of positions engaged and blocking latch bolt movement out of the door frame;

(c) auxiliary latch means carried by the door and movable between a first position projecting out of the door toward the door frame and a second position within the door and clear of the door frame in response to door movement out of the frame;

(d) latch bolt operating means in the door including a rotary element provided with a notch;

(e) lock bar means operable in the door for engaging and disengaging said notch in said rotary element;

(f) first link means resiliently urging said auxiliary latch toward said first position and having an engagement with said dead lock means for holding it out of engagement with said latch bolt;

(g) electrically responsive means in the door frame, said electrically responsive means includes solenoid means, a pair of links having an operative connection between said solenoid means and said plunger means, and ratchet means operative on said plunger means for retaining said plunger means in position with said auxiliary latch clear of the door frame upon energization of said solenoid means; and (h) other link means movable with said first link means and with said auxiliary latch means into its second position and having engagement with said lock bar means to operate said lock bar means into engagement with said rotary element.

* * * * *